US010765233B2

(12) United States Patent
Cassidy et al.

(10) Patent No.: US 10,765,233 B2
(45) Date of Patent: Sep. 8, 2020

(54) UNIVERSAL MERCHANDISING SYSTEM

(71) Applicants: Mike Cassidy, Hoboken, NJ (US); Steve Lorras, Demarest, NJ (US); Greg Skomial, Lake Hiawatha, NJ (US)

(72) Inventors: Mike Cassidy, Hoboken, NJ (US); Steve Lorras, Demarest, NJ (US); Greg Skomial, Lake Hiawatha, NJ (US)

(73) Assignee: DESIGN DISPLAY GROUP, Carlstadt, NJ (US)

( * ) Notice: Subject to any disclaimer, the term of this patent is extended or adjusted under 35 U.S.C. 154(b) by 0 days.

(21) Appl. No.: 16/197,039

(22) Filed: Nov. 20, 2018

(65) Prior Publication Data

US 2019/0150638 A1 May 23, 2019

Related U.S. Application Data

(60) Provisional application No. 62/589,991, filed on Nov. 22, 2017.

(51) Int. Cl.

| | |
|---|---|
| ***A47F 3/06*** | (2006.01) |
| ***A47F 3/14*** | (2006.01) |
| ***A47F 5/00*** | (2006.01) |
| ***A47B 57/58*** | (2006.01) |

(52) U.S. Cl.

CPC ..... *A47F 5/005* (2013.01); *A47B 57/58* (2013.01); *A47F 3/06* (2013.01); *A47F 3/14* (2013.01); *A47F 5/0025* (2013.01); *A47F 5/0043* (2013.01)

(58) Field of Classification Search

CPC ..... A47F 5/005; A47F 5/0025; A47F 5/0043; A47F 3/06; A47F 3/14; A47B 57/58

See application file for complete search history.

(56) References Cited

U.S. PATENT DOCUMENTS

| | | | | | |
|---|---|---|---|---|---|
| 2,636,615 | A * | 4/1953 | Bradley | B43K 23/04 | 211/69.8 |
| 2,845,188 | A * | 7/1958 | Rosenquist | A47B 57/58 | 211/184 |
| 3,182,808 | A * | 5/1965 | Benoit | B65G 15/42 | 211/69.8 |
| 3,269,558 | A * | 8/1966 | Hess | B42F 17/08 | 211/184 |
| 3,508,665 | A * | 4/1970 | Sobel | A47B 57/045 | 211/150 |

(Continued)

FOREIGN PATENT DOCUMENTS

| | | | | |
|---|---|---|---|---|
| CH | 684052 A5 * | 7/1994 | ..... | B25H 3/06 |
| DE | 2361886 A1 * | 6/1975 | ..... | A47B 7/58 |

(Continued)

*Primary Examiner* — Stanton L Krycinski
(74) *Attorney, Agent, or Firm* — Cozen O'Connor

(57) ABSTRACT

A universal merchandising system that includes a base, wherein the base has a front surface and a top surface. The universal merchandising system includes a bristle floor disposed on the top surface of the base. The bristle floor includes a plurality of bristles. The universal merchandising system includes a back wall connected to a back portion of the base. The universal merchandising system further includes binning disposed on a top portion of the back wall.

11 Claims, 14 Drawing Sheets

(56) References Cited

U.S. PATENT DOCUMENTS

| | | | | | |
|---|---|---|---|---|---|
| 3,770,333 | A * | 11/1973 | Cusker | A47B 57/58 | 312/183 |
| 3,905,484 | A * | 9/1975 | Dean | A47B 57/58 | 211/184 |
| 4,759,449 | A * | 7/1988 | Gold | A47B 57/58 | 211/184 |
| 4,858,774 | A * | 8/1989 | Winter | A47B 96/04 | 211/184 |
| 5,201,430 | A * | 4/1993 | Artzer | A47G 21/14 | 206/370 |
| 5,265,729 | A * | 11/1993 | Carlin | B65D 25/06 | 206/557 |
| 5,738,228 | A * | 4/1998 | Bittinger | A47F 7/0021 | 211/60.1 |
| 6,082,559 | A * | 7/2000 | Levsen | A47G 21/14 | 211/70.7 |
| 6,685,034 | B1 * | 2/2004 | Cooke | G11B 33/0461 | 211/40 |
| 8,016,139 | B2 * | 9/2011 | Hanners | A47F 5/005 | 211/184 |
| 9,532,662 | B2 * | 1/2017 | Desmond | A47F 5/0068 | |
| 9,549,622 | B2 * | 1/2017 | Leahy | A47F 5/005 | |
| 2005/0150847 | A1 * | 7/2005 | Hawkinson | A47F 5/005 | 211/59.2 |
| 2007/0256992 | A1 * | 11/2007 | Olson | A47F 5/005 | 211/59.3 |
| 2014/0007403 | A1 * | 1/2014 | Johnson | A47F 5/00 | 29/428 |

FOREIGN PATENT DOCUMENTS

| | | | | | |
|---|---|---|---|---|---|
| DE | 3631690 | A1 * | 3/1988 | B25H 3/06 | |
| DE | 9212392 | U1 * | 1/1993 | A47B 63/00 | |
| DE | 202014102771 | U1 * | 6/2014 | A47B 96/021 | |
| DE | 202014100408 | U1 * | 5/2015 | A47F 5/005 | |
| EP | 2944228 | A1 * | 11/2015 | A47F 5/0025 | |
| FR | 2869779 | A1 * | 11/2005 | A47F 5/005 | |
| GB | 903089 | A * | 8/1962 | A47B 57/58 | |
| GB | 1596325 | A * | 8/1981 | A47B 96/021 | |
| NL | 9000636 | A * | 10/1991 | A47F 5/005 | |

* cited by examiner

UNIVERSAL MERCHANDISING SYSTEM

RELATED APPLICATIONS

This application claims priority from U.S. Provisional Patent Application Ser. No. 62/589,991 which was filed on Nov. 22, 2017, the entire content of which is incorporated by reference.

FIELD OF THE DISCLOSURE

The present invention relates generally to a merchandise display system. More particularly, the present invention relates to a merchandise display platform that has the flexibility to be quickly customized into a desired configuration according the specific needs for the merchandise to be displayed.

BACKGROUND

A retail store may sell various merchandise. Different stores, and different departments in stores, have different merchandise display needs. For example, a store selling cosmetics may have different merchandise display needs compared to a store selling candy. In addition, certain types of merchandise are seasonal. Seasonal merchandise is replaced periodically with new merchandise that have different sizes and shapes. Thus, even for a same store, e.g., a cosmetic retail store, the display needs may constantly change.

The embodiments of the invention disclosed herein are directed to a universal merchandise display system, or it can also be understood as a universal merchandising system ("system"). The system is customizable for different display needs for various merchandise, accommodating different shapes, sizes, heights, products, visual effects, etc., of the merchandise.

SUMMARY OF THE INVENTION

The present invention relates generally to a configurable merchandise display system. More particularly, the present invention is a merchandise display platform that has the flexibility to be quickly customized into a desired configuration according the specific needs the merchandise.

According to a first aspect of the invention, a universal merchandising system includes: a base having a front surface and a top surface; an accessory having an engagement surface having protruding elements; a bristle floor disposed on the top surface of the base, the bristle floor including a plurality of closely-spaced bristles, the bristles being dimensioned and arranged in a density sufficient to provide voids between the bristles that facilitate engagement between the bristle floor and the engagement surface of the accessory to support the accessory in a desired position on the bristle floor; a back wall connected to a back portion of the base; and a binning disposed along a top edge of the back wall, the binning defining support structures for additional support of the accessory in the desired position.

In another aspect, the voids receive the engaging surface of the accessory.

In another aspect, the accessory is configured as a divider, the divider includes a planar body and the protruding elements are disposed at a lower end of the planar body.

In another aspect, when the divider is secured on the bristle floor, the binning receives an upper portion of the planar body of the divider.

In another aspect, the accessory is a stopper, the stopper includes a body and the protruding elements are disposed at a bottom surface of the body.

In another aspect, the accessory is a multi-floor assembly having: a planar body including a second floor support; a plurality of the protruding elements disposed at a lower end of the planar body; and a second floor display, the second floor display being secured to the second floor support. when the multi-floor assembly is secured on the bristle floor, the binning receives an upper portion of the planar body of the multi-floor assembly.

In another aspect, the accessory is a shelf assembly, the shelf assembly includes: a shelf body, a cross bar disposed at a lower portion of the shelf body; and the protruding elements disposed at a lower surface of the cross bar.

In another aspect, the accessory is a shelf assembly, the shelf assembly includes: a shelf body, a cross bar disposed at a lower portion of the shelf body; and the protruding elements disposed at a lower surface of the cross bar.

In another aspect, the shelf body includes a first tier of cells and a second tier of cells stacked on top of the first tier of cells, the cells being configured to receive merchandise.

In another aspect, the system further includes a visual display board assembly, the visual display board assembly including a support base secured to the back wall; a display board secured to the support base, the display board including visual indicia.

In another aspect, the system further includes: a template, the template including a carve out, the carve out having an area that matches to an area of mating protrusions of an accessory, such that the accessory is secured to the bristle floor by the mating protrusions passing through the carve out.

According to one embodiment, a method of using a universal merchandising system, comprising placing a template on a top surface of a bristle floor, wherein the template includes a first carve out, the first carve out exposes a first portion of the bristle floor; selecting an accessory that has mating protrusions matching the first carve out; and inserting the accessory into the exposed first portion of the bristle floor to removably affix the accessory to the bristle floor.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the concepts and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features that are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the disclosed systems and methods, reference is now made to the following descriptions taken in conjunction with the accompanying drawings.

Similar reference numbers in the figures refer to similar features. The features shown in the figures are exemplary only and should not be construed as to limit the scope of the claims.

DETAILED DESCRIPTION

Figure 1:
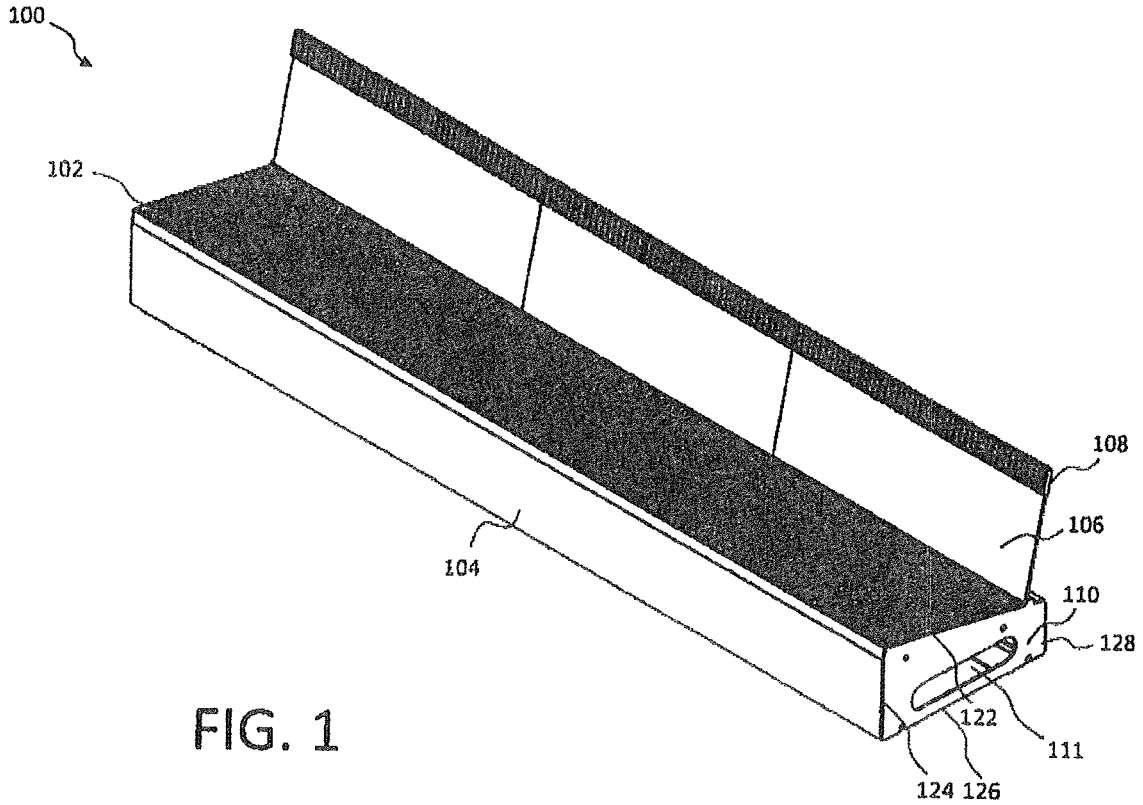
FIG. 1 is a perspective view of a universal merchandising system according to one embodiment of the disclosure.

FIG. 1 is a perspective view of a display unit 100 according to one embodiment of the disclosure. The display unit 100 includes a base 104. The base 104 includes a top surface 122, a front surface 124, a bottom edge 126, and a back surface 128, forming a substantially box shape structure.

A bristle floor 102 is disposed on a top surface 122 of the base 104. The bristle floor 102 includes a plurality of tightly-spaced bristles, preferably arranged in a matrix. Each bristle is an elongated resilient and flexible protrusion with an amount of rigidity. The bristle includes a rounded top end. As a result of the arrangement of the bristles, spaces are provided therebetween. These spaces or voids of the bristle floor 102 are configured to receive mating protrusions of other accessories of the universal merchandising system 100, e.g., a divider 410, a stopper 450, a multi-floor assembly 500, a visual display board 600, and/or a shelf assembly 700, shown in figures to be discussed further below.

The bristle floor 102 provides a flexible attachment mechanism for other accessories to be easily and releasably secured onto the universal merchandising system 100. For example, a divider 410 (see FIG. 4) may include a plurality of lower protrusions that engage spaces in the bristle floor 102. The divider 410 can be secured to any location on the bristle floors 102 by inserting the protrusions of the divider 410, such as by press-fit, into the spaces of the bristle floor 102. The divider 410, as well as any other accessory, can be easily detached and reinserted into a different location on the bristle floor 102 as needed. Thus, the bristle floor 102 provides a customizable attachment mechanism to the accessories such that customized display spaces are configured to accommodate the different sizes, shapes, heights, display sequences of the merchandise to be displayed.

The display unit 100 includes a back wall 106. A section of dividers or "binning" 108 is disposed at a top portion of the back wall 106. The binning can be configured as dividing slots configured to receive and secure an upper portion or side edge of an accessory. For example, the binning 108 can receive an upper portion of the divider 410, such that the upper portion of the divider 410 is secured to the display. In one embodiment, the bristle floor 102 secures a lower portion of an accessory and the binning 108 secures an upper portion of the accessory; in this manner, the bristle floor 102 and the binning 108 together secure the accessory on the display unit 100. In FIG. 1, for example, three sections of back wall 106 are employed, but more can be utilized as needed for a larger display. For any given display arrangement, the sections as arranged together will also be referred to collectively as the "back wall 106". The use of sections allows for flexibility in the size of the overall display.

The front surface of the back wall 106 may include various indicia, e.g., pictures, graphs, symbols, texts, for any appropriate purposes. For example, the back wall 106 may include text and symbols as assembling instructions of the display unit 100. In another example, the back wall 106 may include a picture that highlights the merchandise to be displayed.

The base 104 includes two side panels 110 disposed on two ends (left and right) of the base. The side panels may include a carve out to serve as a handle 111. The side panel 110 may include any indicia, e.g., e.g., pictures, graphs, symbols, texts, for any appropriate purposes.

Figure 2:
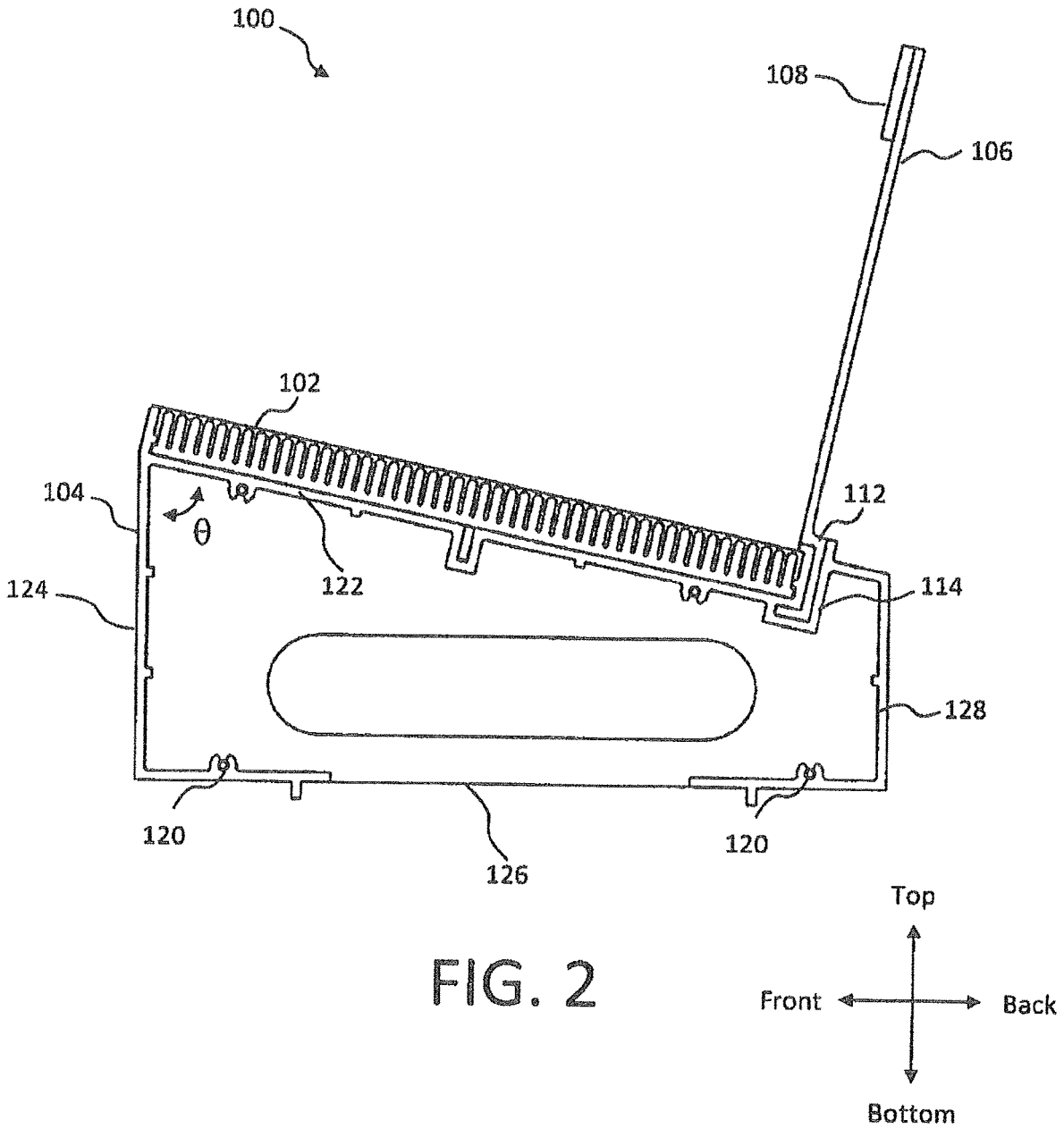
FIG. 2 is a sectional end view of the universal merchandising system according to one embodiment of the disclosure.

FIG. 2 is a sectional view of a display unit 100 according to one embodiment of the disclosure. The display unit includes a base 104. The base 104 includes a top surface 122, a front surface 124, a bottom surface 126, and a back surface 128, forming a substantially box shape structure.

The front surface 124 and the top surface 122 form an angle θ. As shown in FIG. 2, the angle θ is less than 90°. For different display needs, in another embodiment the angle θ can be 90°. In yet another embodiment, the angle θ can be greater than 90°.

The base 104 includes screw holes 120. The screw holes 120 are used to secure the side panels 110. In another embodiment, the base 104 may include any other security means in addition to or instead of the screw holes 120. For example, the base 104 may include snap fit features, magnets, latches, or the like.

The bristle floor 102 is disposed on the top surface 122 of the base 104. The bristle floor 102 includes a plurality of closely spaced bristles. While the bristles may be arranged as a regular matrix with rows and columns, they can be arranged in any manner that provides voids that permit mating with the protrusions of the accessories. Each bristle is an elongated protrusion. In one embodiment, the bristle may include a rounded top end for easy insertion of the mating protrusions of the accessories. The bristles are arranged so that spaces exist between adjacent bristles such that the bristle floor 102 is configured to receive mating protrusions of accessories of the universal merchandising system 100, e.g., a divider 410, a stopper 450, a multi-floor assembly 500, a visual display board 600, and/or a shelf assembly 700.

Figure 4:
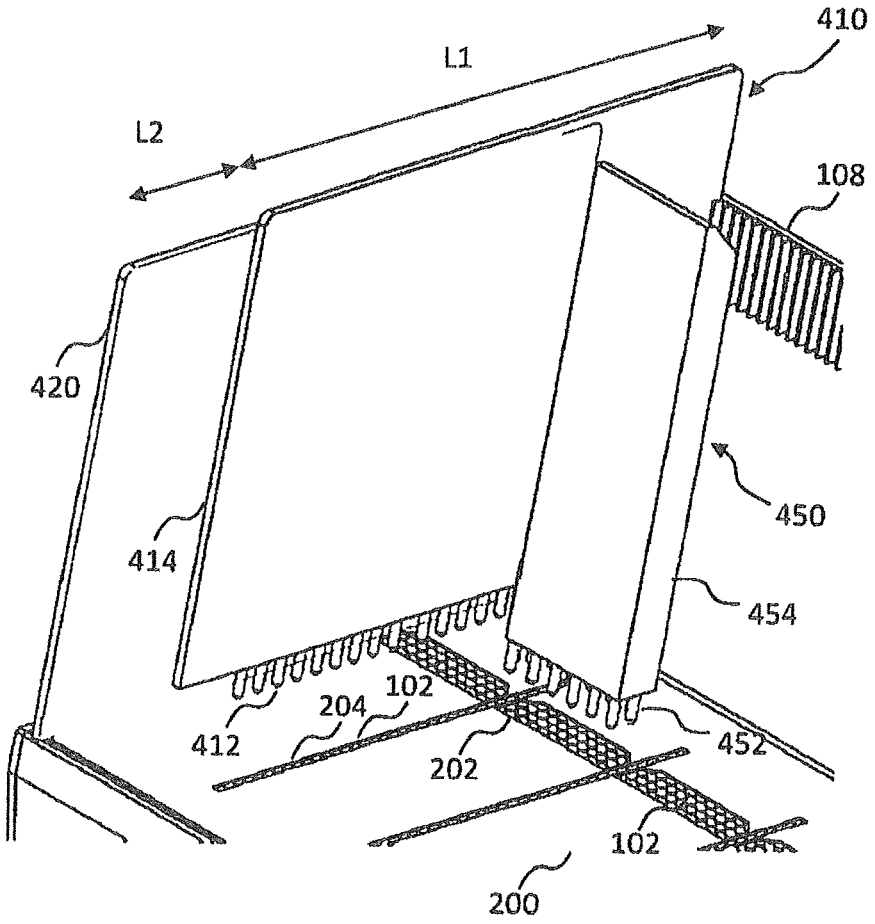
FIG. 4 shows an assembly of a divider and a stopper of a universal merchandising system according to one embodiment of the disclosure.

The bristle floor 102 provides a flexible attachment mechanism for accessories to be secured onto the universal merchandising system 100. For example, a divider 410, as shown in FIG. 4, may include a plurality of protrusions that mate with the spaces (also referred to as "voids") of the bristle floor 102. The divider 410 can be secured to any location on the bristle floors 102 by inserting the mating protrusions of the divider 410 into the voids of the bristle floor 102. The divider 410, as well as any other accessory, can be easily detached and reinserted at a different location on the bristle floor 102 as needed. Thus, the bristle floor 102 provides a customizable attachment mechanism to the accessories such that customized display spaces are configured to accommodate the different sizes, shapes, heights, display sequences of the merchandise to be displayed.

The bristles comprising the bristle floor are preferably formed of Acrylonitrile Butadiene Styrene (ABS) material and are arranged with a preferred density based on a spacing, from bristle center to bristle center, of about 0.1414 inches, with a bristle length of approximately 0.375 inches. Including the base portion, the height of the base is about 0.475 inches. It has been found that such parameters provide adequate stability of various accessories or components, such as dividers, steps, etc.

As can be seen in FIG. 2, in a back portion of the base 104, adjacent to a back end of the bristle floor 102, the base 104 includes a groove 114. The groove 114 is configured to receive a match protrusion, anchor 112, of the back wall 106. The match of the anchor 112 and the groove 114 secures the back wall 106 on the base 104. As shown in FIG. 2, the anchor 112 may be formed in a half rectangular shape. In another embodiment, the anchor 112 can be in a curvature shape, a T shape, a block shape, or the like. The groove 114 is a void that receives the anchor 112.

The binning 108 is disposed at a top portion of the back wall 106. The binning 108 preferably includes dividing slots configured to receive and secure an upper portion of an accessory. For example, the binning 108 can receive an upper portion of the divider 410, such that the upper portion of the divider 410 is secure to the back wall. In one embodiment, the bristle floor 102 secures a lower portion of an accessory and the binning 108 secures an upper portion of the accessory; in this manner, the bristle floor 102 and the binning 108 together secure the accessory on the display unit 100.

Figure 3:
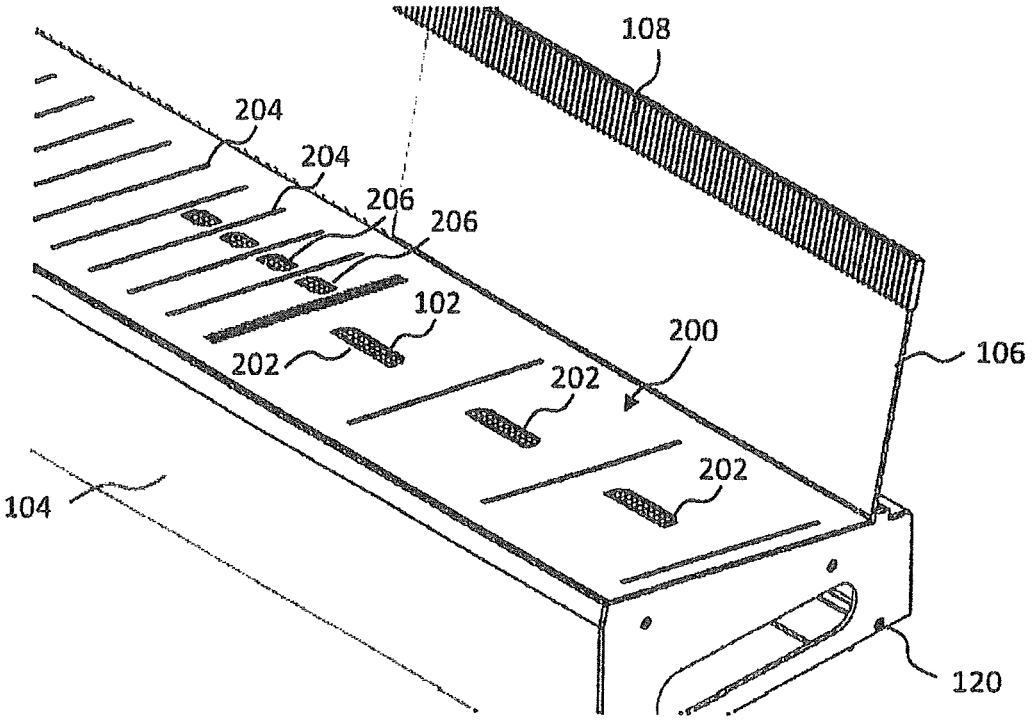
FIG. 3 shows a template used with the universal merchandising system according to one embodiment of the disclosure.

FIG. 3 shows a template 200 of the universal merchandising system according to one embodiment of the disclosure. The template 200 is configured as a flat board that is disposed on top of the bristle floor 102. The template 200 includes various carve outs 202, 204, 206 exposing the bristle floor 102 beneath them. The template 200 may include, for example, a plurality of a first carve out 202. The first carve out 202 is configured to receive a first accessory, e.g., a stopper 450. The template 200 includes a plurality of a second carve out 204. The second carve out 204 is configured to receive a second accessory, e.g., a divider 410. The template 200 may include, for example, a plurality of a third carve out 206. The third carve out 206 is configured to receive a third accessory, e.g., another stopper different (in size and/or shape) from the stopper 450.

Figure 5:
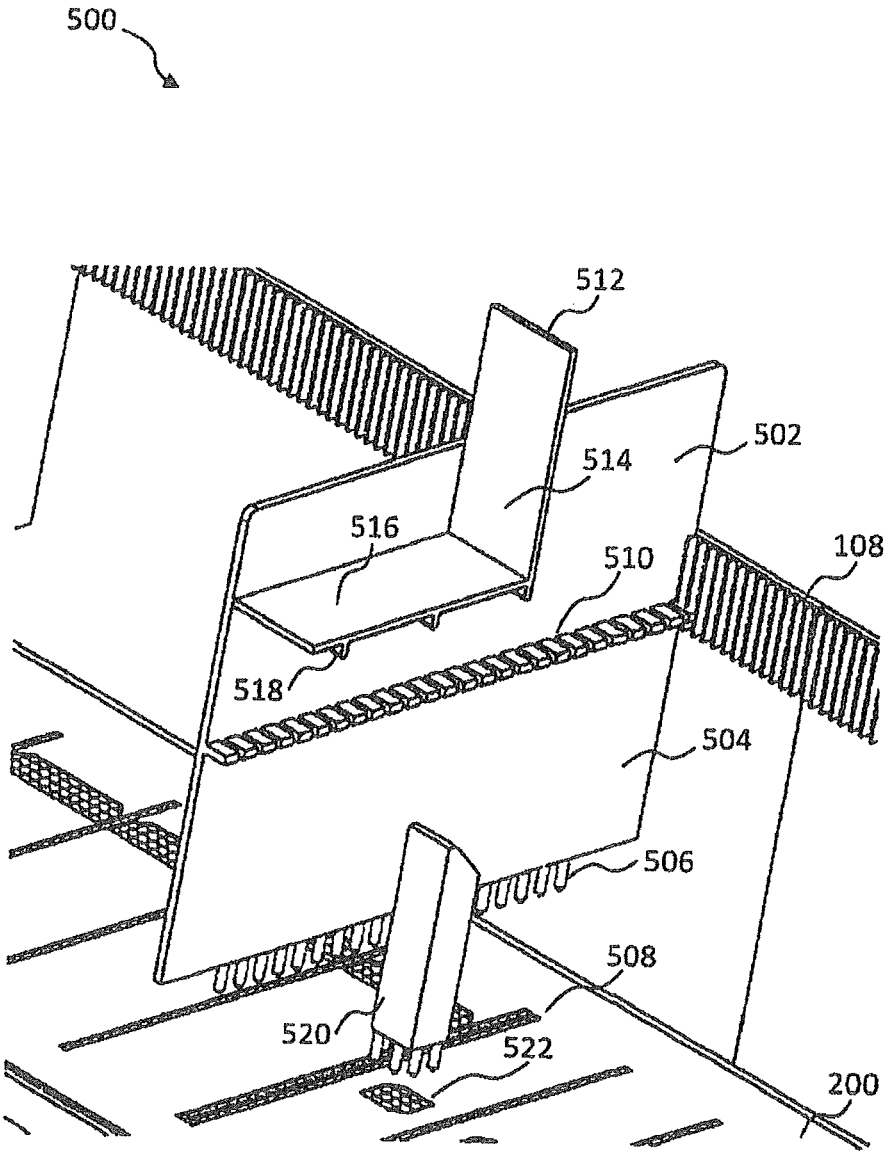
FIG. 5 shows a sectional view of a multi-tier assembly of a universal merchandising system according to one embodiment of the disclosure.
Figure 6:
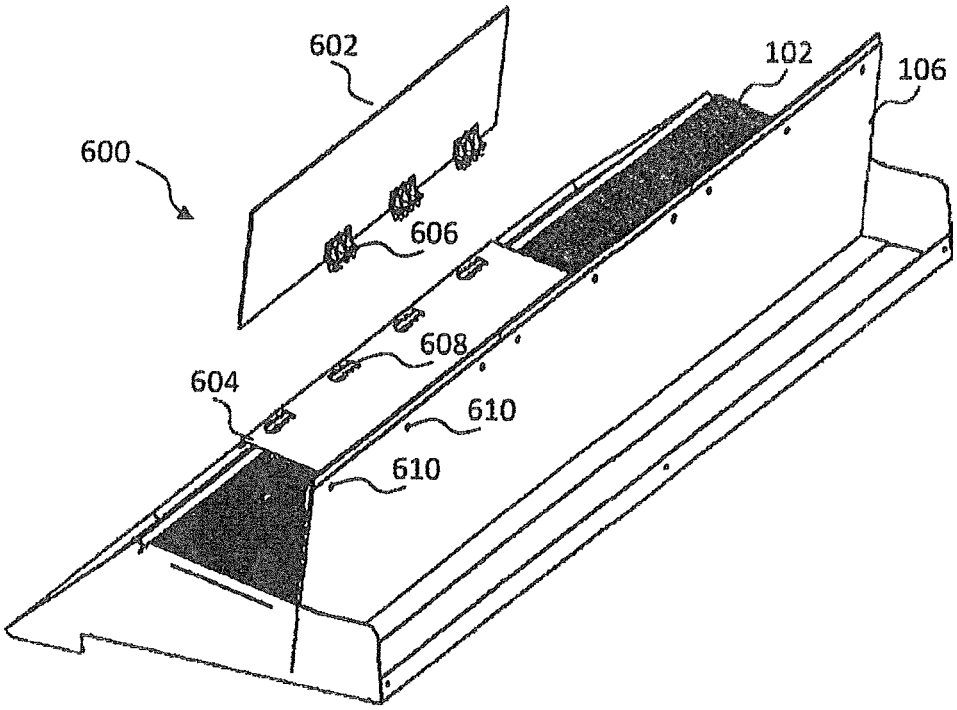
FIG. 6 shows a visual display board connected to a universal merchandising system according to one embodiment of the disclosure.
Figure 7:
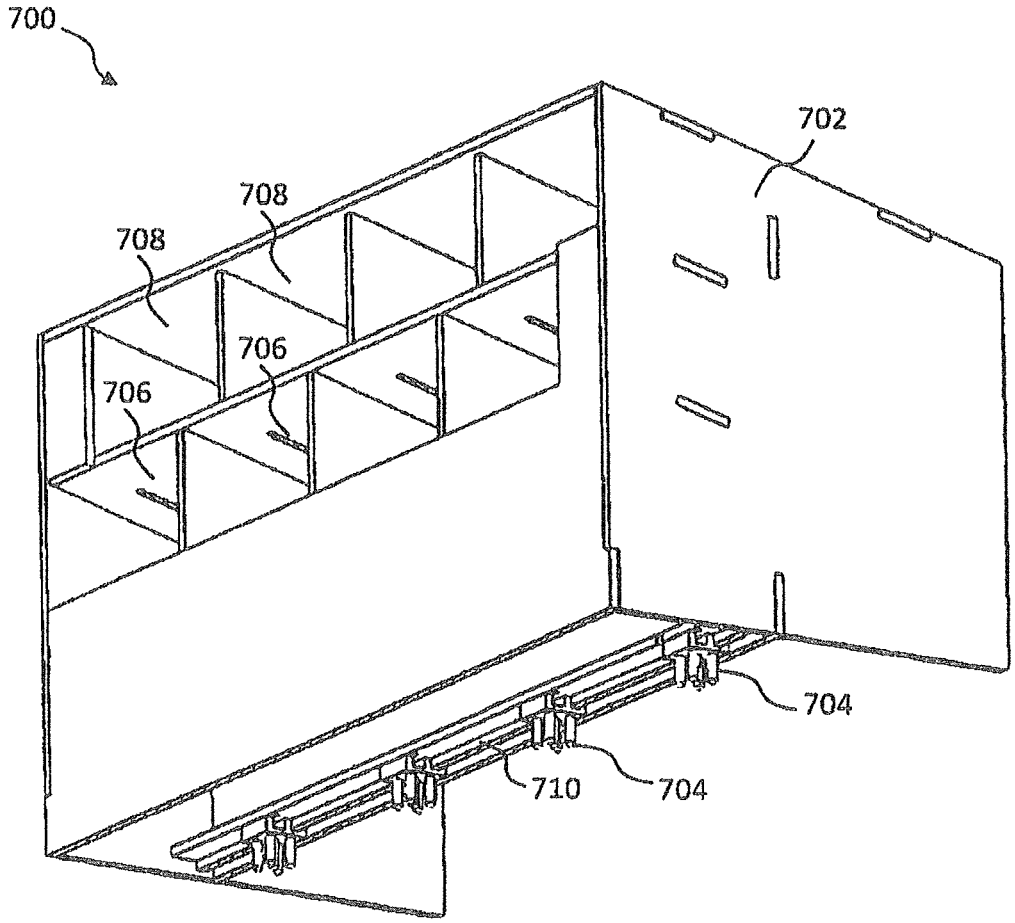
FIG. 7 shows a shelf display module for use with a universal merchandising system according to one embodiment of the disclosure.

In another embodiment, the template 200 may include various carve outs configured to receive any other accessories, e.g., multi-floor assembly 500, visual display board 600, and/or shelf assembly 700, as shown in FIGS. 5, 6 and 7.

The top surface of the template 200 may include various indicia, e.g., pictures, graphs, symbols, texts, for any appropriate purposes. In one embodiment, the template 200 may include text and symbols as assembling instructions of the display unit 100. For example, the template may include text "Stopper 1" adjacent to carve out 202, "Stopper 2" adjacent to carve out 206, and "Divider" adjacent to carve out 204, indicating which accessory should be inserted through the specific carve out. In another example, the template 200 may include a picture that highlights the merchandise to be displayed.

FIG. 4 shows an assembly of a divider 410 and a stopper 450 for a universal merchandising system according to one embodiment of the disclosure. The divider 410 is used to divide the display unit 100 into different spaces for displaying merchandise. The divider 410 includes a planar body 414 and protrusions 412 disposed at a bottom surface of the planar body 414. The protrusions 412 can be inserted into the bristle floor 102 through the specific carve out 204 of the template 200 designed for the divider 410. The binning 108 receives an upper portion of the planar body 414 of the divider 410.

The divider 410 has a length L1, as indicated in FIG. 4. In one embodiment, L1 is shorter than the length (straight or shortest distance from a front end to a back end) of the bristle floor 102. In another embodiment, L1 is the same as the length of the bristle floor 102. In yet another embodiment, L1 is greater than the length of the bristle floor 102. The divider 410 has a height. In one embodiment, the height of the divider 410 is greater than a height of the merchandise to be displayed. In yet another embodiment, the height of the divider 410 is equal or less than a height of the merchandise to be displayed.

FIG. 4 shows that the divider 410 can have an extension 420. The extension 420 may have a length L2. As shown in FIG. 4, the sum of L1 and L2 is substantially equal to the length of the bristle floor 102. The extension 420 can be attached to the divider 410 with any appropriate attachment mechanism, e.g., adhesives, hook and loop (e.g., Velcro®), magnets, or the like, or may be slideable with respect to the divider 410 to lengthen or shorten the overall length, as is known in the art to reduce the depth of the bristle floor with respect to the back wall 106.

The stopper 454 is a physical barrier for shortening the depth of the floor 112. The stopper 450 includes a body 454 and protrusions 452 disposed at a bottom surface of the body 454. The protrusions 452 can be inserted into the bristle floor 102 through the specific carve out 202 of the template 200 designed for the stopper 450. In one embodiment, a back surface of the stopper 450 does not contact the binning 108. In another embodiment, the back surface of the stopper 450 can be in contact with, or secured to, the binning 108.

FIG. 5 shows a multi-floor assembly 500 for a universal merchandising system according to one embodiment of the disclosure. There are situations when two items of merchandise are desired to be displayed one on top of another. The multi-floor assembly 500 allows the merchandise to be stacked and displayed vertically stacked.

The multi-floor assembly 500 includes a multi-floor divider 502. The multi-floor divider 502 includes a planar body 504 and protrusions 506 disposed at a bottom surface of the planar body 504. The protrusions 506 can be inserted into the bristle floor 102 through the carve out 508 of the template 200 designed specifically for the multi-floor divider 502.

The multi-floor divider 502 includes a second floor support 510. The second floor support 510 includes a plurality of horizontally extending protrusions. There are voids separating the individual horizontal protrusions of the second floor support 510. The voids are configured to receive securing protrusions 518 of a second floor display 512.

The second floor display 512 includes a back support 514 and a bottom support 516 connected to each other. The second floor display 512 provides a display platform stacked on top of a lower display space. Securing protrusions 518 are disposed at a bottom surface of the bottom support 516. The specific size, depth, width, and height of the second floor display 512 can be configured to accommodate the specific merchandise.

The multi-floor assembly 500 further includes a lower level stopper 520 that can be inserted into the bristle floor 102 through the carve out 522 of the template 200.

FIG. 6 shows a visual display board assembly 600 for a universal merchandising system according to one embodiment of the disclosure. The visual display board assembly 600 includes a display board 602 and a support base 604. The display board 602 is secured on the base 604 with one or more anchors 606 through a preferable snap-fit coupling made up of a protrusion extending into opening 608 and may provide for pivoting of edge 602 from a vertical position (not shown) to a horizontal position as shown. The display board 602 may include any indicia desired, e.g., pictures, graphs, text, numbers, symbols, that promotes the sale of the merchandise.

The support base 604 can be secured at any location on the back wall 106 through screws 610 or any other appropriate securing structure.

FIG. 7 shows a shelf assembly 700 for a universal merchandising system according to one embodiment of the disclosure. The shelf assembly 700 includes a shelf body 702. The shelf body 702 includes multiple cells 706 and 708. The cells 706, 708 are used to store and display merchandise. The shelf body 702 may include a plurality of floors of cells. As shown in FIG. 7, the shelf 702 includes cells 706 in a first floor and cells 708 in a second floor.

The shelf assembly 700 includes a cross bar 710 disposed at a bottom of the shelf body 702. A plurality of bristle connectors 704 are attached to the cross bar 710 with protrusions facing downward. The protrusions of the bristle connectors 704 can be inserted into the voids of the bristle floor to secure the shelf assembly 700 in place.

The template 200 may include specific carve outs that match the orientation of the bristle connectors 704.

Figure 8:
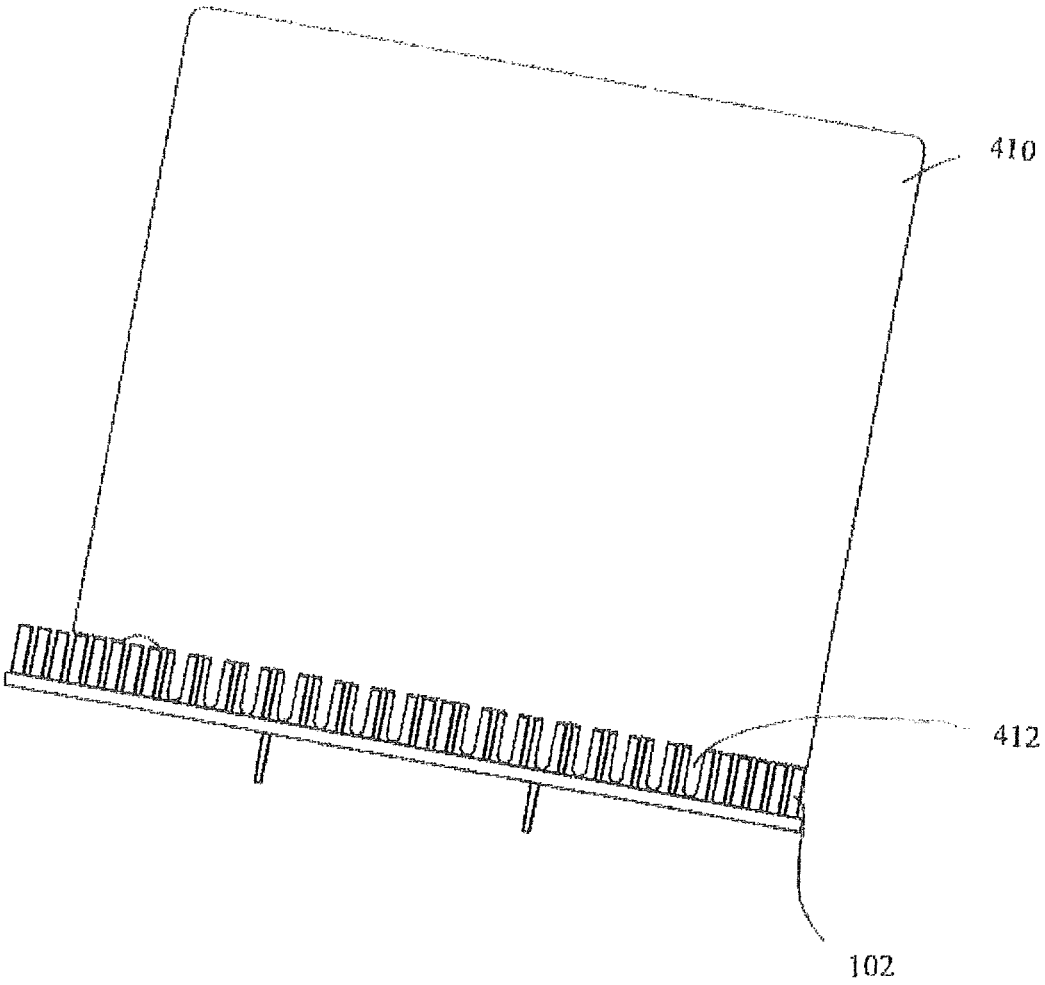
FIG. 8 is a diagram showing how the protrusions of an accessory connect to the bristle floor 102.

FIG. 8 is a diagram showing how protrusions 412 of an accessory 410, for example, engage with the bristle floor 102. As can be seen in the figure, when the protrusions 412 engage the bristle floor 102, they lodge in the voids between the floor bristles.

Figure 9:
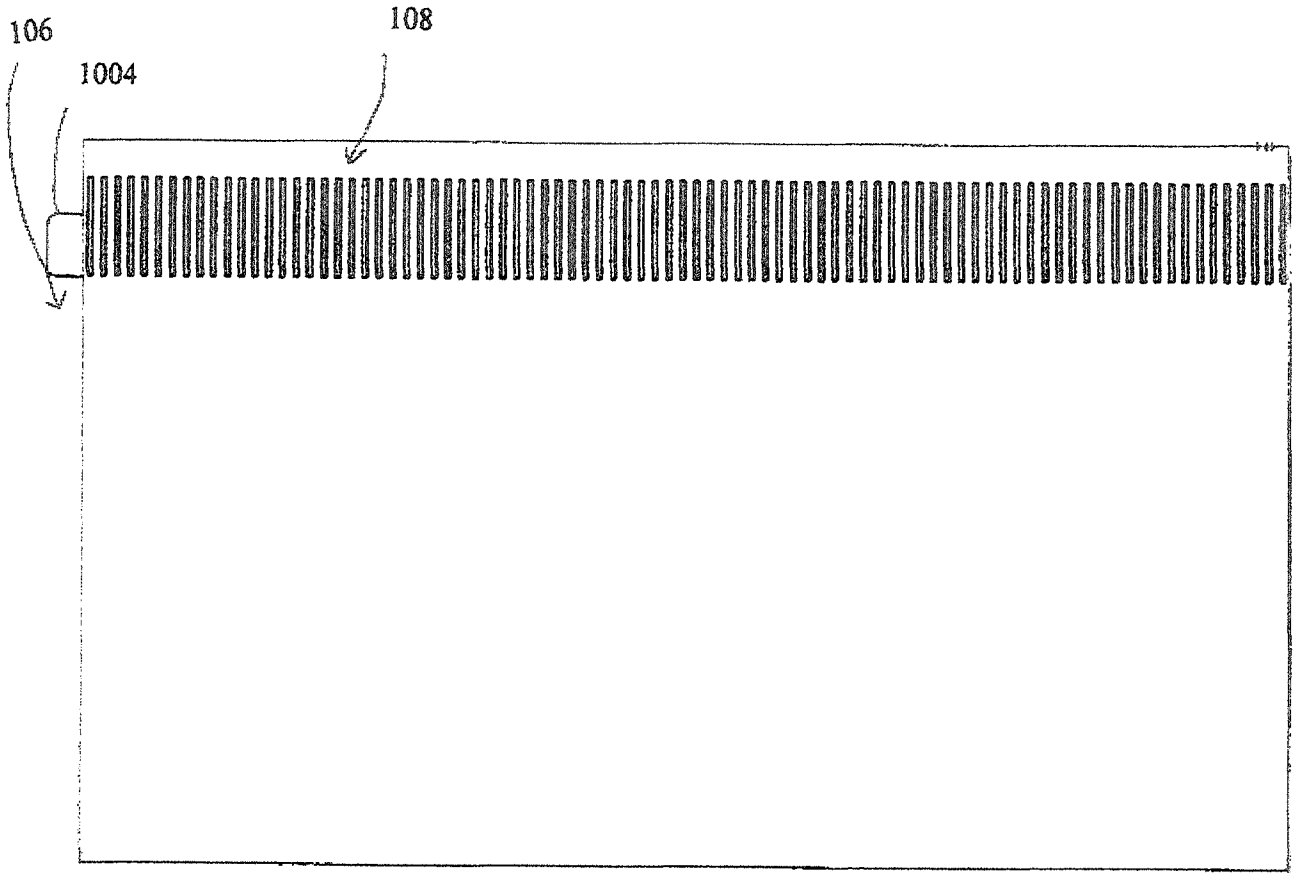
FIG. 9 is a front elevational view of one segment of the back wall, showing the binning.
Figure 10:
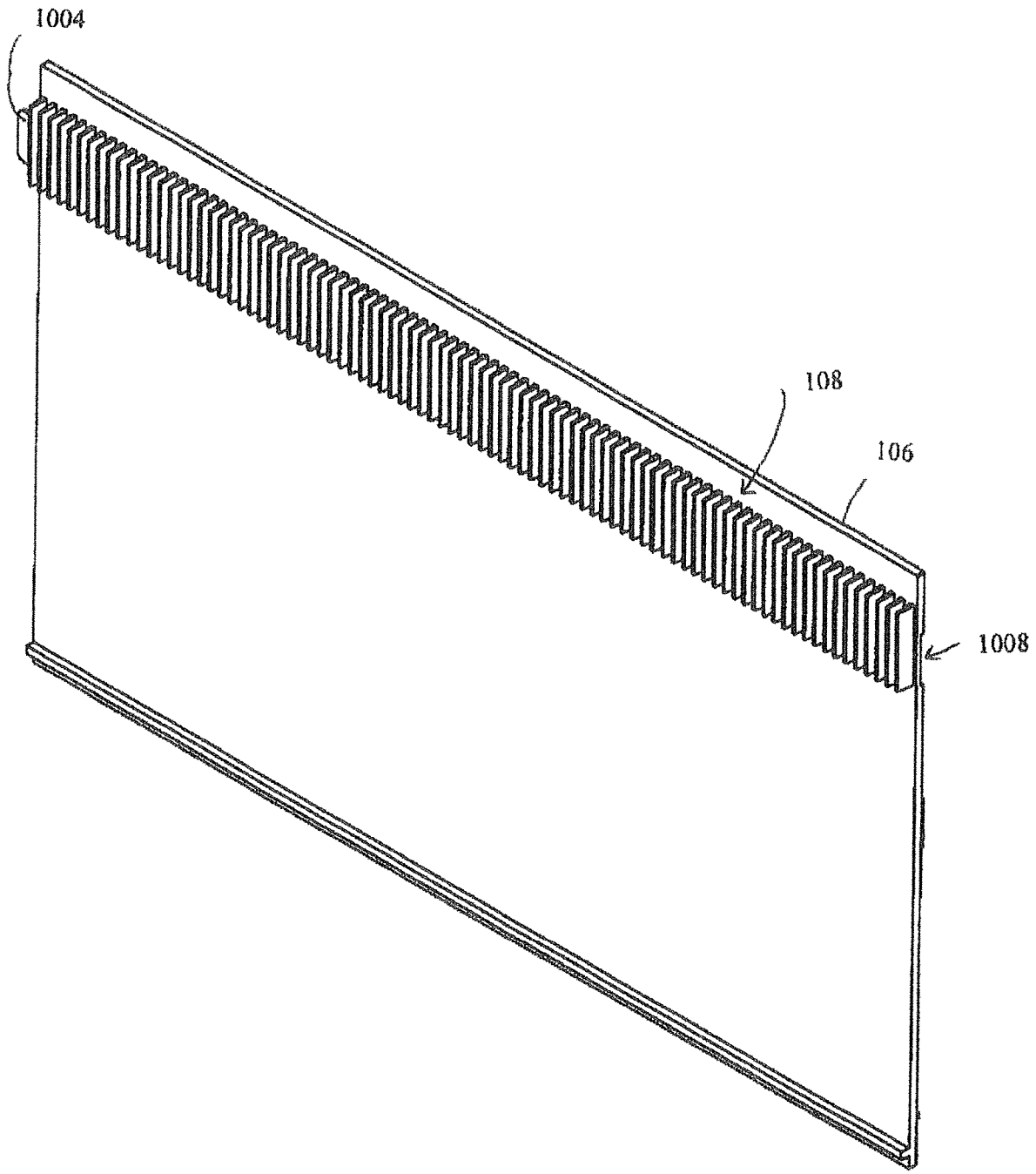
FIG. 10 is a perspective view of an individual segment of the back wall.

FIG. 9 is a front elevational view of one segment of back wall 106, showing the binning 108. Also shown in FIG. 9 is a tab 1004 that can be inserted into a corresponding slot 1008 (see FIG. 10) of an adjacent wall segment to form a multi-segmented back wall 106, for example as shown in FIG. 1. The width of each binning element is preferably about 0.056 inches and the pitch between the elements is preferably about 0.86, from center to center between adjacent elements. Preferably each segment of back wall 106 has a height of about 7.324 inches and width of about 12.291 inches. The corresponding slot 1008 can be seen in FIG. 10, which is a perspective view of an individual segment of back wall.

Figure 11:
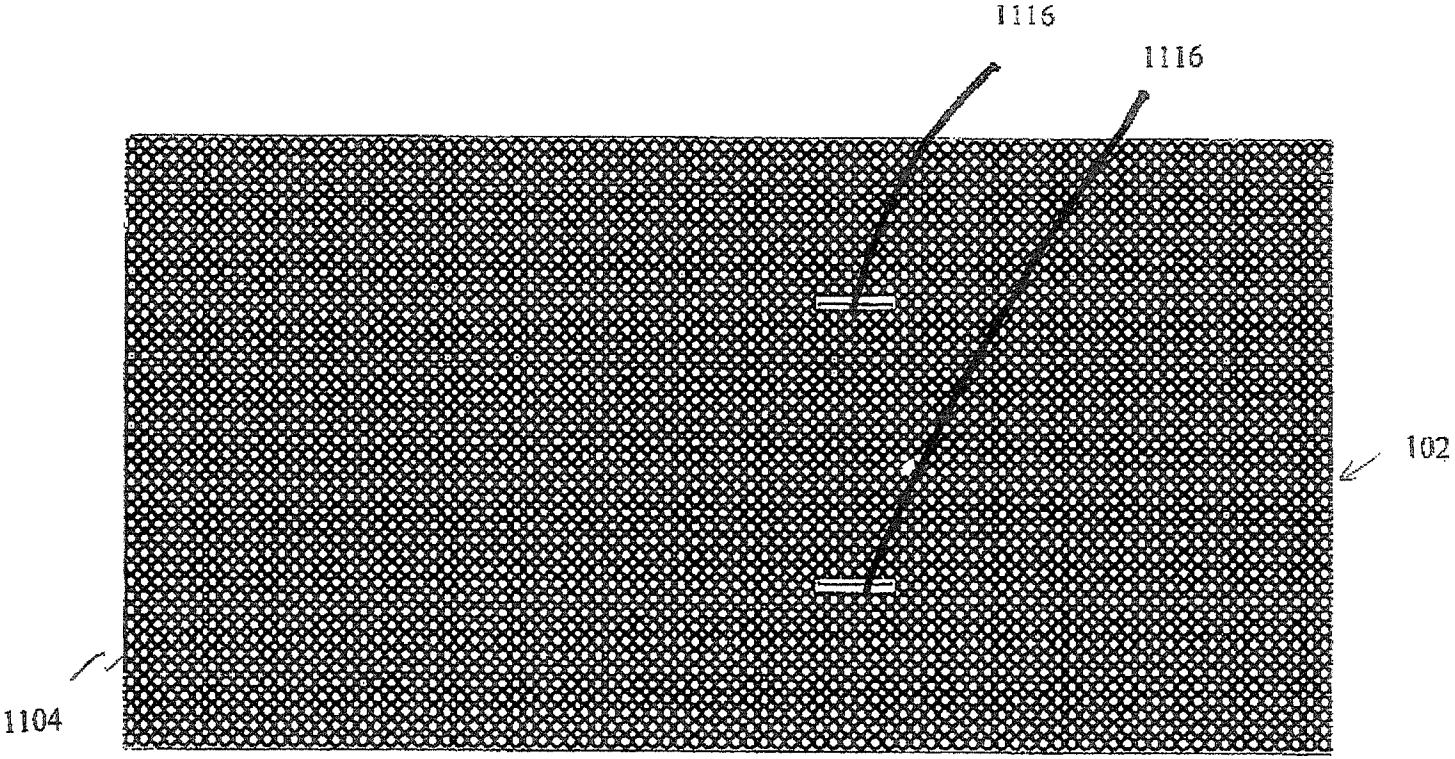
FIG. 11 is a top plan view of segment of a bristle floor.

FIG. 11 is a top plan view of segment of a bristle floor 102. Depending upon the size of the display, the bristle floor might require multiple segments. Thus, the term bristle floor 102 and a segment of such a floor will generally be used interchangeably herein, since what is being described will be clear from context. A side male connector 1104 can be seen at the left of FIG. 11. This connector can engage a side female connector 1108, which will be illustrated in a figure to be discussed below.

Figure 12:
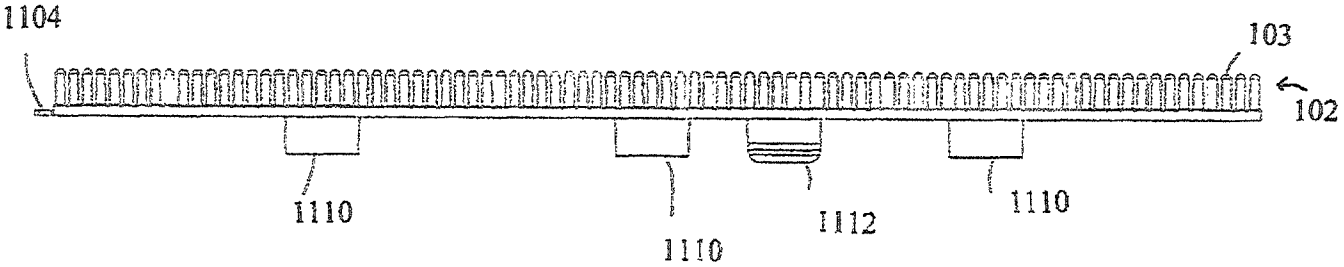
FIG. 12 is a side view from the longer side of the segment of the bristle floor shown in FIG. 11.

FIG. 12 is a side view from the longer side of the segment 102. As can be seen in FIG. 12, the side male connector 1104 protrudes at the left side of the figure. Mold release structures 1110 are used to help release the mold from which the segment 102 is formed from the tool—which is preferably formed from injection molding. Clips 1112, shown in FIG. 12, are used to clip into the substructure of the display under the floor 102. The slots 1116 shown in FIG. 11 are used for forming the clips 1112 during the molding process of the segments 102.

Figure 13:
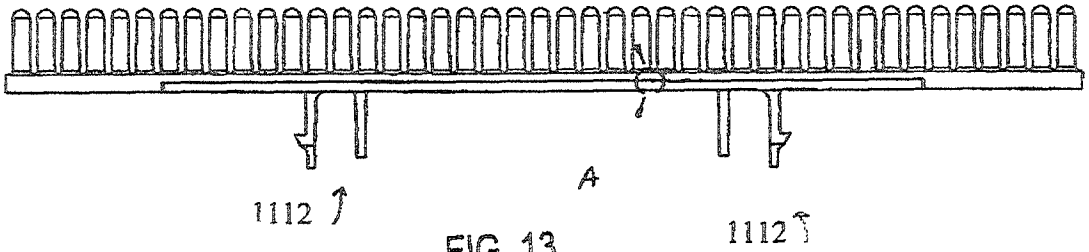
FIG. 13 is a side view from the shorter right hand side as seen from FIG. 11.

FIG. 13 is a side view from the shorter right hand side as seen from FIG. 11. FIG. 13 shows the two clips 1112 and indicates an area of detail A, which is shown in FIG. 14.

Figure 14:
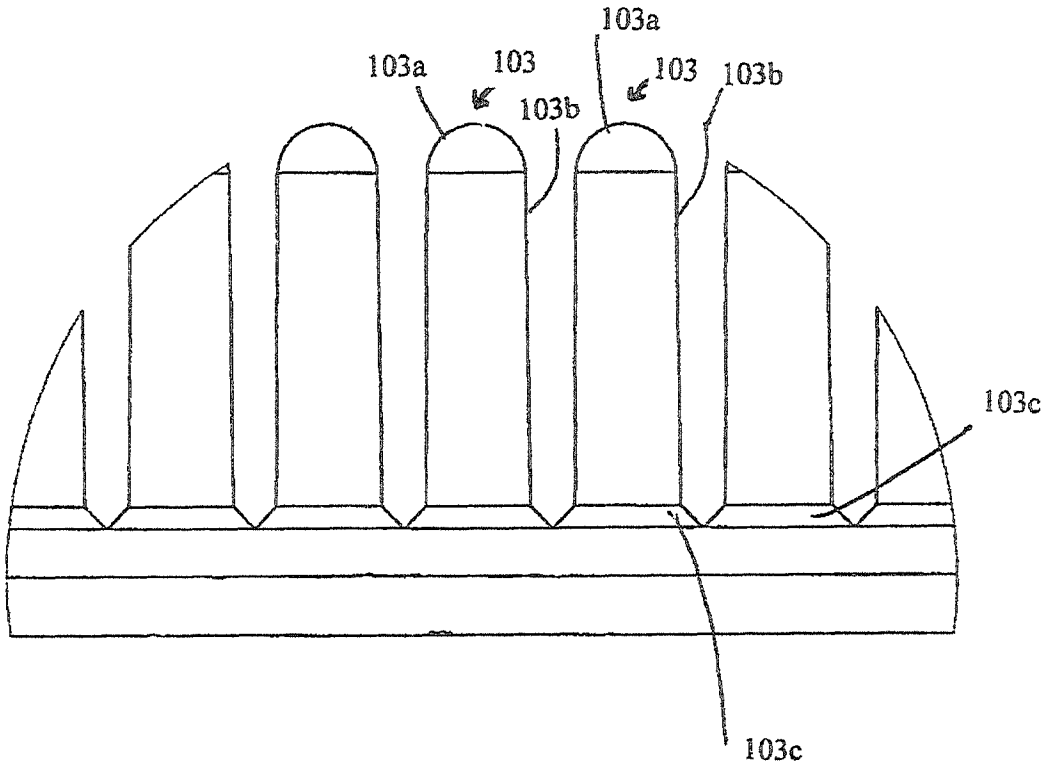
FIG. 14 shows a three-part construction of each bristle.

FIG. 14 shows a three-part construction of each bristle 103. That is, preferably, each bristle 103 has a tip 103*a*, a shaft 103*b* and a frustoconical base 103*c*.

Figure 15:
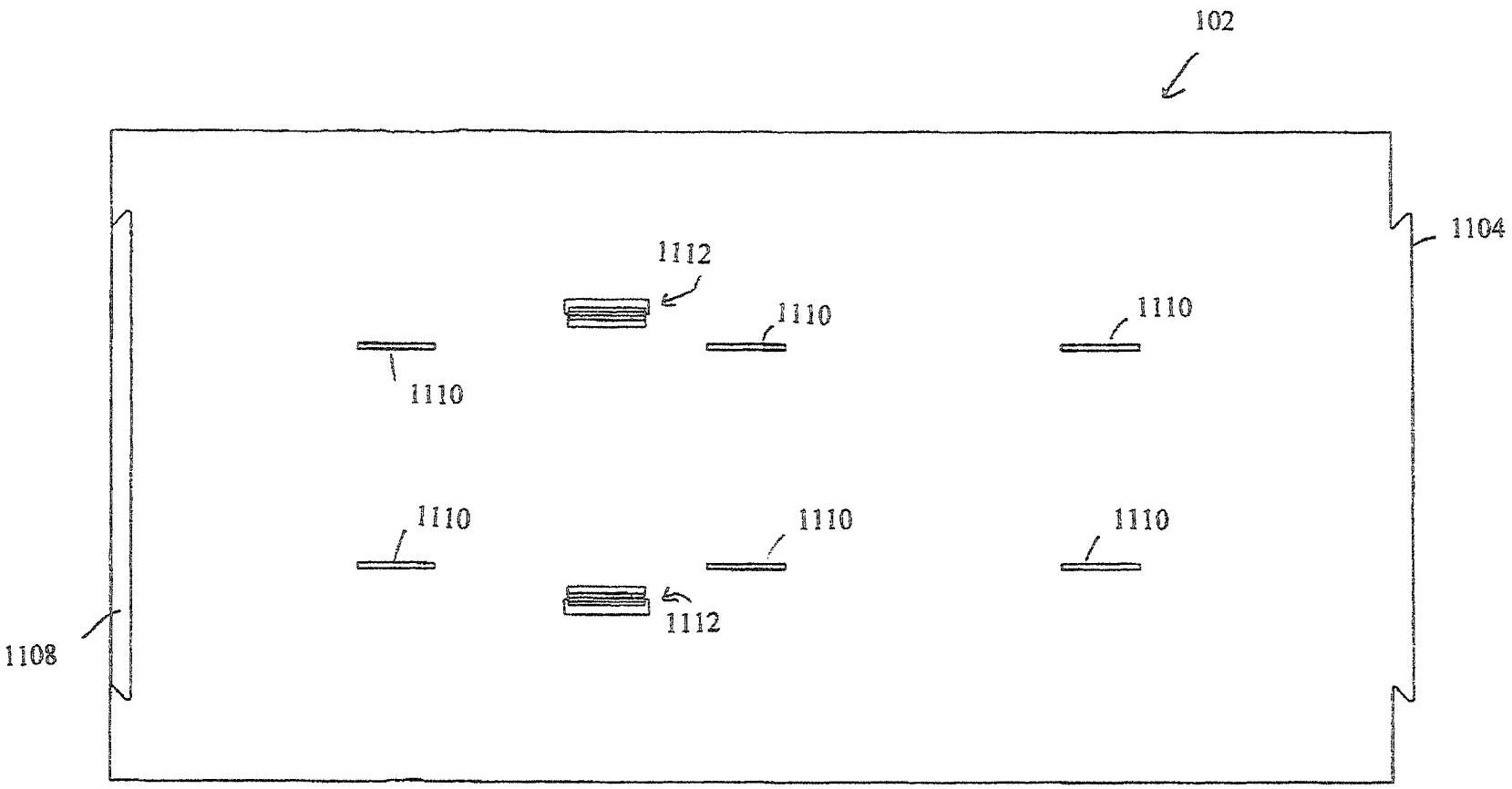
FIG. 15 is a bottom view of a segment of the bristle floor.

FIG. 15 is a bottom view of a segment of the bristle floor 102. In addition to the structures shown in other figures, FIG. 15 shows the side female connector 1108, which, as discussed above, is used to connect to male connector of an adjacent segment of a bristle floor to form a multi-segmented floor 102.

Figure 16:
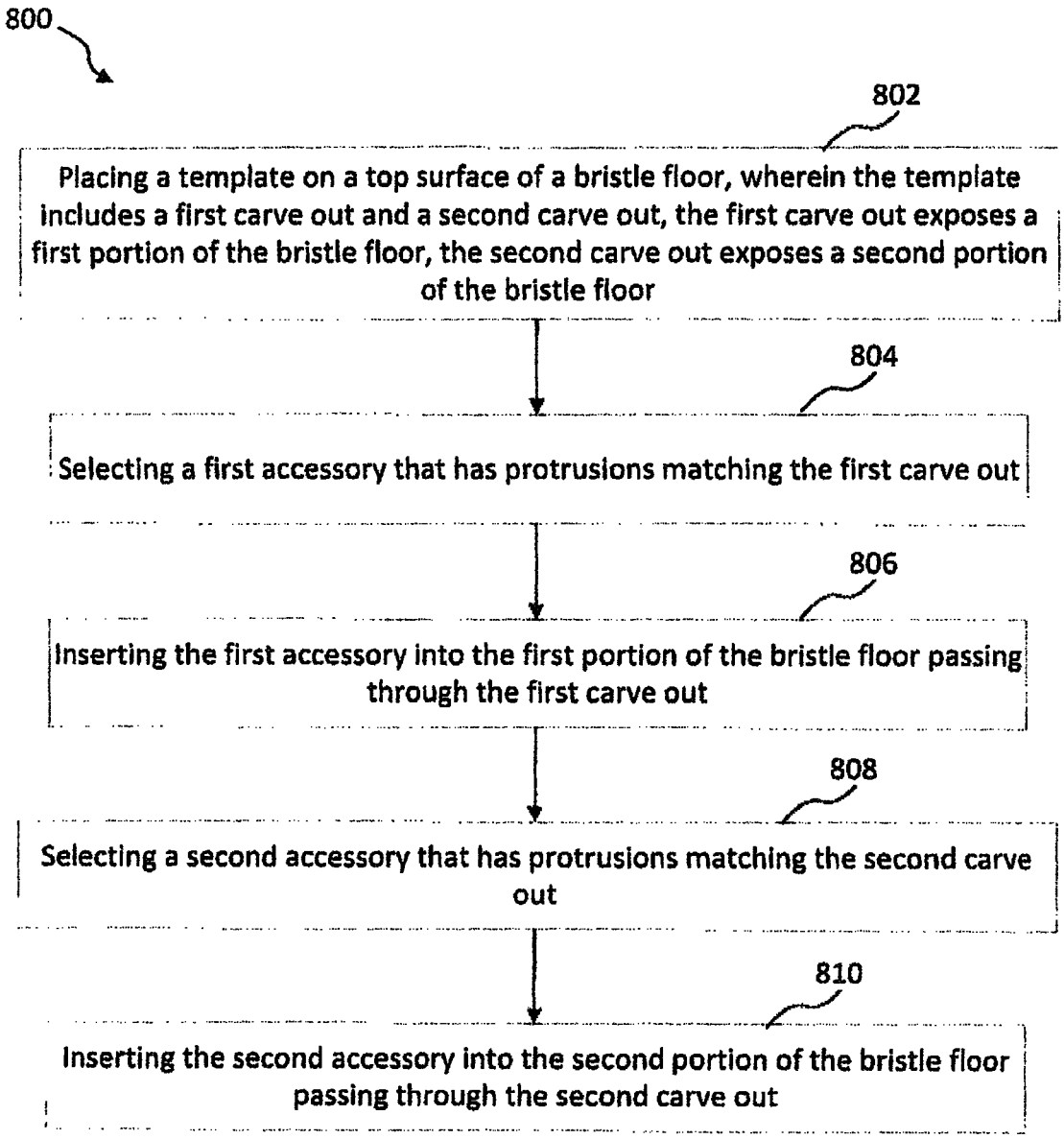
FIG. 16 is a flow chart of a method using the universal merchandising system.

FIG. 16 shows a flow diagram of a method 800 of using the universal merchandising system. Step 802 includes placing a template 200 on top of a bristle floor 102. The template includes a first carve out and a second carve out. The first carve out exposes a first portion of the bristle floor 102. The second carve out exposes a second portion of the bristle floor 102.

Step 804 includes selecting a first accessory that has protrusions matching the first carve out. Step 806 includes inserting the accessory into the first portion of the bristle floor through the first carve out.

Step 808 includes selecting a second accessory that has protrusions matching the second carve out. Step 810 includes inserting the second accessory into the second portion of the bristle floor through the second carve out. The method 800 can be applied to any of the accessory embodiments shown in FIGS. 1-15.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present invention, disclosure, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A universal merchandising system, comprising:

a base having a front surface and a top surface;

an accessory having an engagement surface having protruding elements;

a bristle floor disposed on the top surface of the base, the bristle floor including a plurality of bristles, the bristles being dimensioned and arranged in a density sufficient to provide voids between the bristles that facilitate engagement between the bristle floor and the engagement surface of the accessory to support the accessory in a desired position on the bristle floor;

a back wall connected to a back portion of the base; and a binning disposed along a top edge of the back wall, the binning defining support structures for additional support of the accessory in the desired position.

2. The universal merchandising system of claim 1, wherein the protruding elements releasably engage the voids in a press-fit manner.

3. The universal merchandising system of claim 2, wherein the accessory is a divider, the divider includes a planar body and the protruding elements are disposed at a lower end of the planar body.

4. The universal merchandising system of claim 3, wherein when the divider is secured on the bristle floor, the binning receives an upper portion of the planar body of the divider.

5. The universal merchandising system of claim 2, wherein the accessory is a stopper, the stopper includes a body and the protruding elements are disposed at a bottom surface of the body.

6. The universal merchandising system of claim 2, wherein the accessory is a multi-floor assembly, the multi-floor assembly includes a planar body including a second floor support;

a second floor display, the second floor display being secured to the second floor support;

wherein the protruding elements are disposed at a lower end of the planar body.

7. The universal merchandising system of claim 6, wherein when the multi-floor assembly is secured on the bristle floor, the binning receives an upper portion of the planar body of the multi-floor assembly.

8. The universal merchandising system of claim 2, wherein the accessory is a shelf assembly, the shelf assembly includes a shelf body, a cross bar disposed at a lower portion of the shelf body; and the protruding elements disposed at a lower surface of the cross bar.

9. The universal merchandising system of claim 8, wherein the shelf body includes a first tier of cells and a second tier of cells stacked on top of the first tier of cells, the cells being configured to receive merchandise.

10. The universal merchandising system of claim 1, further comprising:

a visual display board assembly, the visual display board assembly including a support base secured to the back wall;

a display board secured to the support base, the display board including visual indicia.

11. The universal merchandising system of claim 1, further comprising:

a template, the template including a carve out, the carve out having an area that matches to an area of mating protrusions of an accessory, such that the accessory is secured to the bristle floor by the mating protrusions passing through the carve out.

* * * * *